United States Patent [19]

Shimizu et al.

[11] 4,331,898

[45] May 25, 1982

[54] IMAGE INTENSIFIER WITH TWO-LAYER INPUT WINDOW

[75] Inventors: Tatuo Shimizu, Kawasaki; Hisao Ishiwata, Kamakura; Tetsu Sano, Tokyo; Yoshimitsu Aramaki, Kawasaki, all of Japan

[73] Assignee: Tokyo Shibaura Denki Kabushiki Kaisha, Kawasaki, Japan

[21] Appl. No.: 113,193

[22] Filed: Jan. 18, 1980

[30] Foreign Application Priority Data

Jan. 24, 1979 [JP] Japan ..... 54-6123

[51] Int. Cl.[3] ..... H01J 35/00

[52] U.S. Cl. ..... 313/59; 220/2.1 R; 250/213 VT; 250/369; 313/101; 313/110

[58] Field of Search ..... 313/59, 99, 101, 102, 313/110; 250/369, 482, 483, 487, 213 VT; 220/2.1 R, 2.3 R

[56] References Cited

U.S. PATENT DOCUMENTS 3,419,741 12/1968 Legendre ..... 313/59
4,122,967 10/1978 Rohrich ..... 313/101
4,238,043 12/1980 Minami et al. ..... 313/102

FOREIGN PATENT DOCUMENTS 2151079 4/1973 Fed. Rep. of Germany .
2331210 10/1974 Fed. Rep. of Germany .
3420832 12/1956 Japan .

*Primary Examiner*—Davis L. Willis
*Attorney, Agent, or Firm*—Cushman, Darby & Cushman

[57] ABSTRACT

In an image intensifier comprising an evacuated envelope which comprises a cylindrical vessel, an input window member airtightly sealed to one end of the vessel, and an output container formed at the other end of the vessel, at least said one end portion of the cylindrical vessel is formed of metal, the input window member has a multilayer structure including an outer thin plate formed of metal weldable to the metal which constitutes at least said one end portion of the cylindrical vessel and an inner thin plate formed of aluminum or aluminum alloy which is thicker than the outer thin plate, the peripheral portion of the inner thin plate is pressure-bonded to an inner portion of a flange at the one end portion of the cylindrical vessel, and the peripheral portion of the outer thin plate extends beyond the peripheral portion of the inner thin plate and is fused with an outer portion of the flange.

10 Claims, 5 Drawing Figures

IMAGE INTENSIFIER WITH TWO-LAYER INPUT WINDOW

This invention relates to an image intensifier, more specifically to an X-ray image intensifier with an improved input window portion.

As generally known, an X-ray image intensifier is a kind of image tube which converts an X-ray image modulated by being passed through a subject into a visible light image. Conventionally, an input window portion on which the X-ray image falls and an output vacuum container portion are made of glass. Since it is difficult to reduce or enlarge the X-ray image which has passed through the subject, the diameter of the input window portion of the X-ray image intensifier is limited to 150 to 400 mm, generally. Further, the inside of the X-ray image intensifier is kept at a high vacuum. In consideration of these circumstances, the thickness of the glass plate of the input window portion need be 3 to 4 mm.

When X-rays fall on such glass window portion, there will be caused scattered X-rays. These scattered X-rays would lower the contrast property of a visible light image appearing on an output phosphor screen.

In order to obviate such drawback attributable to the use of the glass plate for the input window portion, light metal such as aluminum or aluminum alloy has been tried instead of glass material. If aluminum is used for the window portion, the thickness of the window portion need be only 1 mm or thereabouts for e.g. an image intensifier of 9-inch diameter to prevent atmospheric-pressure-induced distortion. Such level of thickness would cause less scattered X-rays, and thus the contrast property of the visible light image can be improved.

However, it is very difficult to join aluminum with glass or any other metal than aluminum, so that it is hard to achieve airtight sealing between the input window portion made of aluminum and a cylindrical vessel made of glass or any other metal than aluminum which constitutes the main body of an evacuated envelope. Accordingly, the use of an aluminum window portion requires, for example, such a measure as one disclosed in German Pat. No. 2,331,210. However, such method for sealing between the aluminum window portion and cylindrical vessel is uneconomical, necessitating a large-scaled apparatus.

Moreover, the input window portion may be formed of e.g. stainless steel which can easily be welded to various metals. In this case, although airtight sealing between the input window portion and cylindrical vessel may no doubt be achieved with ease, stainless steel absorbs a large quantity of X-rays, so that the intensity of X-rays to reach an input phosphor screen inside the window portion will be lowered to reduce gains of the image intensifier. Particularly where the input window is made thin for the purpose of minimizing the amount of absorbed X-ray, it is unavoidable that the input window becomes concave at the time of evacuation of the image intensifier tube. If, in this case, we try to obtain an image intensifier tube having an electron lens the same in property as the electron lens of an image intensifier tube having a convex input window, the entire length of the envelope must be long.

The object of this invention is to provide an image intensifier ensuring ease of sealing between a window portion and vessel and good contrast of output images.

According to this invention, an image intensifier has an evacuated envelope which comprises a cylindrical vessel, an input window member airtightly sealed to one end of the vessel, and an output container formed at the other end of the vessel, the image intensifier characterized in that at least said one end portion of the cylindrical vessel is formed of metal, that the input window member has a multilayer structure including an outer thin plate formed of metal weldable to the metal which constitutes at least said one end portion of the cylindrical vessel and an inner thin plate formed of aluminum or aluminum alloy which is thicker than the outer thin plate, that the peripheral portion of the inner thin plate is held on an inner portion of a flange provided at the one end portion of the evacuated cylindrical vessel, and that the peripheral portion of the outer thin plate extends beyond the peripheral portion of the inner thin plate and is fused with an outer portion of the flange.

This invention can be more fully understood from the following detailed description when taken in conjunction with the accompanying drawings, in which.

In an image intensifier according to this invention, an input window member has a multilayer structure including an outer thin plate formed of a metal which can be welded to an end portion of a cylindrical vessel constituting the main body of an evacuated envelope, and an inner thin plate formed of aluminum or aluminum alloy. Airtight sealing between the input window member and the cylindrical vessel is accomplished by the use of the outer thin plate of a material or metal which can be welded to various metals. On the other hand, the durability against atmospheric pressure of the input window member is maintained by the inner thin plate, that is, the input window member is protected against distortion by the inner thin plate formed of aluminum or aluminum alloy which fully transmits X-rays. Therefore, the outer thin plate must be thin enough to prevent reduction of gains due to absorption of X-rays, while the inner thin plate must be thick enough to prevent the input window member from being distorted. Thus, the outer thin plate is 20 to 200 $\mu$m thick, preferably 30 to 100 $\mu$m, and the inner thin plate is 0.5 to 1.2 mm thick for an image intensifier with a diameter of 6 to 9 inches, for example.

According to this invention, the outer thin plate is formed of any one of metals which can be welded to one end portion of the cylindrical vessel. Such metals include titanium, stainless steel, nickel, nickel alloy, Kovar (trade name), Mumetal (trade name), etc. Mumetal and other high-permeability alloys are preferred because they can check adverse effects of earth magnetism and external magnetic fields of other apparatus, such as distortion of output image.

The material of the cylindrical vessel may be metal of glass. When using metal for the cylindrical vessel, it should be a metal weldable to such a metal member as Kovar that can be fused with glass because the cylindrical vessel is airtightly sealed to a glass output container by means of the metal member. Such material resembles the material of the outer thin plate. When using glass for the cylindrical vessel, on the other hand, the cylindrical vessel is formed in a body with the output container, having its one end portion made of Kovar or some other metal that can be welded to glass and the outer thin plate. Thus, the outer thin plate is airtightly sealed to the glass cylindrical vessel by means of the metal member.

Now there will be described an X-ray image intensifier of this invention with reference to the accompanying drawings.

Figure 1:
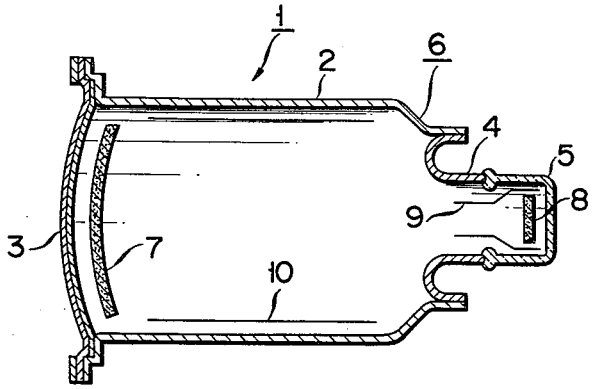
FIG. 1 is a sectional view of an X-ray image intensifier according to an embodiment of this invention.

Referring now to the drawing of FIG. 1 showing a sectional view of an X-ray image intensifier according to an embodiment of the invention, an X-ray image intensifier 1 includes an evacuated envelope 6 which consists of a cylindrical vessel 2 made of metal, a slightly convexly curved X-ray input window member 3 airtightly sealed to one end of the cylindrical vessel 2, and a glass output container 5 airtightly sealed to the other end of the cylindrical vessel 2 by means of a metal member 4 which is formed of a metal capable of being welded to glass, such as e.g. Kovar (trade name), and has a U-shaped section. Inside the envelope 6, there are an input screen 7 disposed near the X-ray input window member 3 and formed of an input phosphor screen and a photoelectric screen, an output phosphor screen 8 located inside the output container 5 opposite to the input screen 7, an anode 9 surrounding the output phosphor screen 8, and a focusing electrode 10 in close vicinity to the inside wall of the cylindrical vessel 2.

Figure 2:
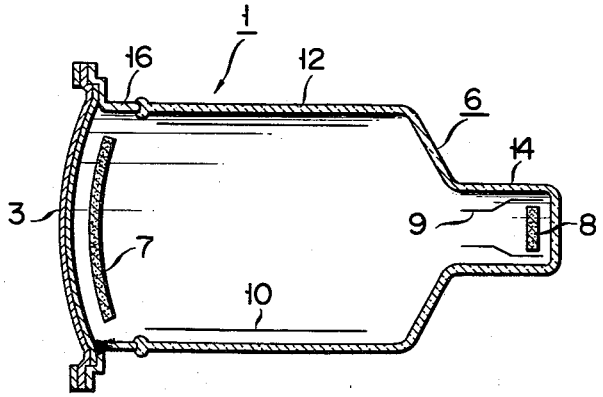
FIG. 2 is a sectional view of an X-ray image intensifier according to another embodiment of the invention.

FIG. 2 is a sectional view of an X-ray image intensifier according to another embodiment of the invention. In this X-ray image intensifier, a cylindrical vessel 12 and an output container 14 are integrally formed of glass material, and an X-ray input window member 3 is airtightly sealed to the cylindrical vessel 12 by means of a metal member 16 which constitutes an end portion of the cylindrical vessel 12 and is made of a metal capable of being fused with a glass material such as Kovar. The image intensifier of such construction has advantages in reduced number of components and simplified processes of assembly.

Figure 3:
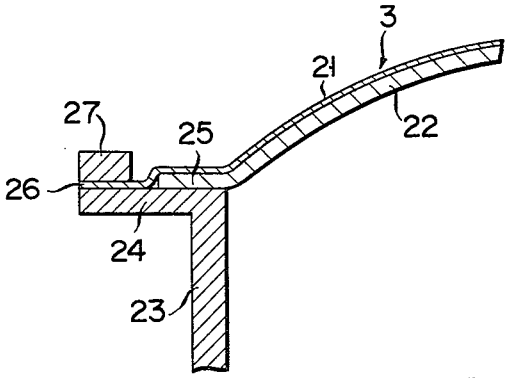
FIG. 3 is an enlarged view of a sealed portion between an X-ray input window member and a cylindrical vessel of the X-ray image intensifier of FIG. 1 or 2.

FIG. 3 is an enlarged view of a sealed portion between the cylindrical vessel and input window member of the X-ray image intensifier of FIG. 1 or 2. In FIG. 3, the X-ray input window member 3 has a two-layer structure including an outer thin plate 21 having a thickness of 50 to 100 μm and made of high-permeability alloy containing e.g. 78 wt. % of Ni, 5 wt. % of Mo and Fe for the remainder, and an inner thin plate 22 formed of an Al plate with a thickness of 0.5 to 1 mm. A peripheral portion 25 of the inner thin plate 22 is mounted on the inner portion or axis-side portion of a flange 24 which is formed at an end portion of a cylindrical vessel made of the same or different metal as or from the material of the outer thin plate 21. The outer thin plate 21 is greater than the inner thin plate 22 in diameter, having its peripheral portion 26 extended outward beyond the peripheral portion 25 of the inner thin plate 22 and mounted on the outer portion of the flange 24. Held between the flange 24 and a metal ring 27, the peripheral portion 26 of the outer thin plate 21 is bonded to the flange 24 by e.g. inert gas arc welding. With such construction, the outer thin plate can be formed thin and the input window member can easily hermetically be sealed to be cylindrical vessel. The inner thin plate 22 is pressured and held to the flange 24 by utilizing atmospheric pressure when the envelope 6 is evacuated.

Figure 4:
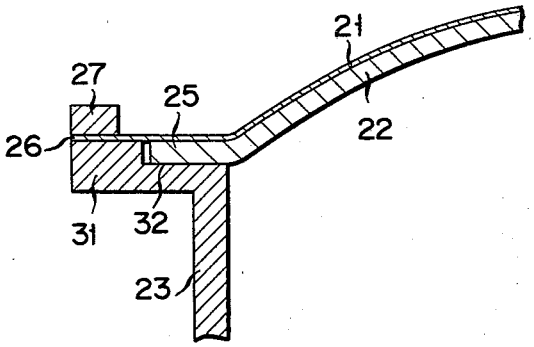
FIGS. 4 and 5 show alternative examples of the sealed portion.

FIG. 4 shows another example of the sealed portion between the X-ray window member and the cylindrical vessel. In FIG. 4, a circular step 32 is formed at the inner portion of a flange 31, and the peripheral portion 25 of the inner thin plate 22 is mounted on the step 32.

Figure 5:
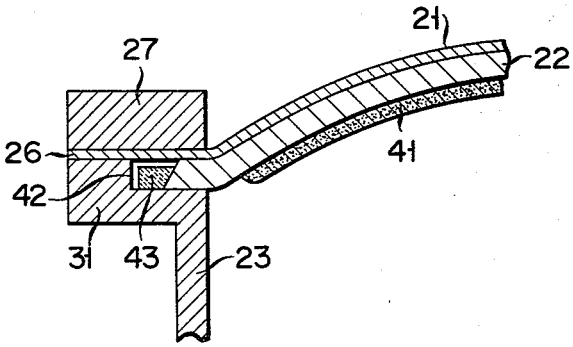

In the image intensifiers shown in FIGS. 1 and 2, the input phosphor screen is provided separately from the input window member. In still another example of the sealed portion as shown in FIG. 5, however, an input phosphor screen 41 is put on the inside of the inner thin plate 22. In this case, heat will be transmitted to the inner thin plate 22 to deteriorate the input phosphor screen 41 while the peripheral portion 26 of the outer thin plate 21 is being welded to the flange 31. In order to prevent this, a heat insulating material 43 formed of e.g. a ceramic is inserted in a gap portion 42 defined or surrounded by the outer thin plate 21, inner thin plate 22 and flange 31.

In the above-mentioned X-ray image intensifier of the invention provided with the X-ray input window member of the two-layer structure, airtight sealing between the X-ray input window member and the cylindrical vessel 12 is fully secured by the outer thin plate 21, and satisfactory durability against atmospheric pressure can be provide by the use of the inner thin plate 22. Thus, there may be obtained an image intensifier which ensures perfect airtight sealing between the input window member and the cylindrical vessel and good contrast property of output images, without involving any distortion of the input window member. Especially if the outer thin plate 21 alone or the outer thin plate 21 and the cylindrical vessel 12 are formed of Mumetal or some other high-permeability alloy, external magnetic fields are shielded thoroughly, and distortion of output images due to such external magnetic fields will be prevented.

To verify the superiority of the image intensifier of the invention over the prior art image intensifiers, we conducted the following experiment.

First, when an X-ray input window member was formed by using a stainless steel plate of 0.2-mm thickness in an X-ray image intensifier with 6-inch tube input window, X-rays at an energy level of 60 keV were attenuated to approximately 74% by their transmitting through the X-ray input window member. In consideration of the durability against atmospheric pressure, the thickness of the stainless steel plate need be 0.2-mm or more.

On the other hand, an X-ray input window member of the invention which has a two-layer structure including a stainless steel plate of 50-μm thickness and an aluminum plate of 0.5-μm thickness exhibited an X-ray transmission rate of 89%. Such X-ray transmission rate, which is greatly improved as compared with the value for the stainless steel plate of 0.2-mm thickness, is scarcely lower than a value of 91% for the single aluminum plate of 0.5-mm thickness. This input window member displayed satisfactory durability against atmospheric pressure and caused minimal scattered X-rays. Although an input window member formed of a glass material of 3-mm thickness exhibited an X-ray transmission rate as high as 88%, it was not able to avoid deterioration of the contrast property of output images due to scattering of X-rays.

According to this invention, the outer thin plate may be made up by forming a flat metal plate into a spherical shape by pressing or drawing. Further, according to the invention, where the outer thin plate is formed of Mumetal, it is annealed under a temperature of, for example, 1000° C. or more, the decrease in the permeability of it due to the stress during the forming step can be recovered to the original level. The material of the inner thin plate is not limited to aluminum, and the mechanical strength of the plate may be further improved by using e.g. an alloy which contains 0.5 wt. % of Mg, 1.0 Wt. % of Si, 0.3 Wt. % of Fe and Al for the remainder. This improvement may be made without a large loss in the transmitting amount of X-rays.

Although X-ray image intensifiers have been described herein, the invention may be also applied to an image intensifier for detecting a high-energy ray such as $\gamma$-ray image intensifiers.

What we claim is:

1. An image intensifier comprising:

an evacuated envelope which comprises a cylindrical vessel;

an input window member airtightly sealed to one one end of said vessel, and an output container formed at the other end of said vessel, at least said one end portion of the said cylindrical vessel being formed of metal so that said input window member has a multilayer structure including an outer thin plate, not of aluminum or an aluminum alloy, and formed of metal weldable to the metal which constitutes at least said one end portion of said cylindrical vessel and an inner thin plate formed of aluminum or aluminum alloy which is thicker than said outer thin plate, the peripheral portion of said inner thin plate being held to an inner portion of a flange at said one end portion of said cylindrical vessel, and the peripheral portion of said outer thin plate being held to an inner portion of a flange at said one end portion of said cylindrical vessel, and the peripheral portion of said outer thin plate extending beyone the peripheral portion of said inner thin plate and being fused with an outer portion of said flange.

2. An image intensifier according to claim 1, wherein said cylindrical vessel is formed of metal, said output container formed of glass material being airtightly sealed to the other end of said cylindrical vessel by means of a metal member which can be fused with glass material.

3. An image intensifier according to claim 1, wherein said cylindrical vessel is formed of a glass material formed in a body with said output container and a metal member welded to one end portion of said glass material.

4. An image intensifier according to any one of claims 1 to 3, wherein said outer thin plate is formed of any one metal selected from the group consisting of titanium, stainless steel, Ni, Ni alloy, metals weldable to glass material, and high-permeability metals.

5. An image intensifier according to claim 4, wherein said outer thin plate is formed of a high permeability metal.

6. An image intensifier according to claim 2, wherein said cylindrical vessel is formed of any one metal selected from the group consisting of stainless steel, Ni, Ni alloy, metals weldable to glass material, and high-permeability metals.

7. An image intensifier according to claim 6, wherein said cylindrical vessel is formed of a high-permeability alloy.

8. An image intensifier according to claim 1, wherein a metal ring is disposed on the outside of the peripheral portion of said outer thin plate.

9. An image intensifier according to claim 1, wherein a ring-shaped heat insulating material disposed outside the peripheral portion of said inner thin plate.

10. An image intensifier according to claim 1, wherein said image intensifier is an X-ray image intensifier.

* * * * *